United States Patent [19]

Yamate

[11] Patent Number: 4,992,099

[45] Date of Patent: Feb. 12, 1991

[54] PRINTING PASTE, METHOD FOR PRINTING TEXTILE PRODUCTS USING THE PASTE, AND TEXTILE PRODUCTS OBTAINED THEREBY

[76] Inventor: Masato Yamate, 612-2, Oaza-managura, Ekiya-cho, Fukuyama-shi, Hiroshima-ken, Japan

[21] Appl: No.: 417,252

[22] Filed: Oct. 5, 1989

[30] Foreign Application Priority Data

Oct. 6, 1988 [JP] Japan ..... 63-253324

[51] Int. Cl.[5] ..... C09D 11/02

[52] U.S. Cl. ..... 106/24; 106/124; 106/157

[58] Field of Search ..... 106/24, 124, 157

[56] References Cited

U.S. PATENT DOCUMENTS

| | | | |
|---|---|---|---|
| 2,185,181 | 1/1940 | Bronsztajn | 106/24 |
| 2,361,009 | 10/1944 | Carman et al. | 106/24 |
| 3,533,811 | 10/1970 | Clements et al. | 106/24 |

FOREIGN PATENT DOCUMENTS 2216338 8/1974 France .

*Primary Examiner*—Mark L. Bell
*Assistant Examiner*—Helene Klemanski
*Attorney, Agent, or Firm*—McAulay Fisher Nissen & Goldberg

[57] ABSTRACT

The printing paste according to the present invention contains egg yolk as the adhesive paste. The painting paste is prepared as a uniformly kneaded mixture comprising 100 wt. parts of egg yolk, 1-10 wt. parts of a preservative, 1-10 wt. parts of a lower alcohol, 20-40 wt. parts of an alkyd paint, and 5-30 wt. parts of a water soluble resin clear paint. The printing method comprises the steps of printing a design on the surface of a textile product at room temperature under ambient pressure, fixing the alkyd paint together with the paste on the textile product by drying the textile product, removing the residual paste from the textile products by washing with water, and drying the product. As the egg yolk acts as a paste and an adhesive to fix the alkyd paint on the textile product with improved fastness, the alkyd paint will remain fast on the textile product withstanding repeated washings.

6 Claims, No Drawings

PRINTING PASTE, METHOD FOR PRINTING TEXTILE PRODUCTS USING THE PASTE, AND TEXTILE PRODUCTS OBTAINED THEREBY

BACKGROUND OF THE INVENTION (1) Field of the Invention

The present invention relates to a printing paste, a method for printing designs on textile product surfaces and products obtained thereby. More particularly, it relates to a technique for printing designs using a paste added with egg yolk as an adhesive paste for improved color fastness to washing.

(2) Description of the Prior Art

Washable products, such as, bed linens used in hotels and hospitals, are printed with designs, such as, a name, logo, or mark. To print such designs, a printing paste containing a dye, additive(s) and an adhesive paste is directly applied on the textile, which, in turn, is subsequently subjected to steaming or dry heating for coloring and fixing. Most of the adhesive pastes contained in the printing paste act as a medium for promoting transfer of the dye and the additive(s) to the textile and are removed by washing with water after the printed design is fixed on the textile.

According to the conventional printing of textiles, the dye is chemically adhered on the textile so that after repeated washing for more than ten times, the printed design would disadvantageously fade or disappear.

SUMMARY OF THE INVENTION

An object of the present invention is to obviate the above problem and to provide a printing paste and a method for printing a design in characters and graphics on textiles that will not fade or disappear but withstand repeated washing.

Another object of the present invention is to provide textile products printed with designs by this invention method.

In order to achieve the above objects, the printing paste according to the present invention is a uniformly kneaded mixture comprising 100 wt parts of egg yolk, 1–10 wt. parts of a preservative, 1–10 wt. parts of a lower alcohol, 20–40 wt. parts of an alkyd paint, and 5–30 wt. parts of a water soluble resin clear paint.

The printing method according to the present invention comprises the steps of applying said printing paste in the form of an aimed design on the surface of a textile product at room temperature and ambient pressure, drying said textile product to fix said alkyd paint together with the printed paste, washing the textile product with water to remove the residual paste and drying the textile.

DESCRIPTION OF THE PREFERRED EMBODIMENTS

The egg yolk to be used in the present invention may be the egg yolk of any bird, including those with the longer diameter of 30 cm or bigger and smaller ones with the diameter of ca. 1 cm. Because of the low price and availability in terms of quantity, chicken eggs are preferable.

Freshly laid eggs are shelled and separated into the yolk and the white. This separation is preferably conducted on an industrial scale using a known apparatus or tool. Because there is little risk of foaming even if the egg yolk is mixed, the following three methods are recommended for preparing the printing paste.

According to the first method, the egg yolk is thoroughly agitated into a pasty state at room temperature under ambient pressure using a commercial blender. The pasty egg yolk is thoroughly blended with a preservative and a lower alcohol at room temperature under ambient pressure to obtain a stock solution. The stock solution is further kneaded with an alkyd paint and a water soluble resin clear paint at room temperature under ambient pressure.

The second method comprises the steps of adding the pasty egg yolk obtained as per the first method to a mixture of the preservative and the lower alcohol, thoroughly agitating the mixture at room temperature under ambient pressure to obtain a stock solution, adding the alkyd paint and clear paint, and kneading the mixture at room temperature under ambient pressure.

The third method comprises the steps of blending the preservative and the lower alcohol simultaneously with the egg yolk immediately after separation from the egg white, thoroughly agitating the mixture at room temperature under ambient pressure to obtain a stock solution, and blending the alkyd paint and clear paint with the stock solution and kneading at room temperature under ambient pressure.

One or more than two preservatives to be used in the present invention are selected from food preservatives, such as, sorbic acid, ortho-phenylphenol, sodium benzonate, salt, sugar, salicylic acid, dehydroacetic acid, and para-hydroxybenzoic ester. Particularly, sorbic acid, ortho-phenylphenol, sodium benzonate, salt and sugar are preferable for their low price and availability.

Methyl alcohol or ethyl alcohol is preferable as the lower alcohol for its high affinity to egg yolk and to preservatives as well as for its disinfectant property.

The ratio of the preservative and lower alcohol to be blended in the stock solution is 1–10 wt. parts for preservative and 1–10 wt. parts for lower alcohols as against 100 wt. parts of egg yolk. When the amount of preservative is less than 1 wt. part, the egg yolk will easily become putrid, whereas if it exceeds 10 wt. parts, the adhesive property of the egg yolk decreases. When the amount of lower alcohol is less than 1 wt. part, it becomes difficult to uniformly mix the preservative with the egg yolk. On the other hand, if the amount exceeds 10 wt. parts, the resultant stock solution becomes insufficient in viscosity, making it difficult to adequately handle the printing paste as the paste dries too quickly during the printing process.

The alkyd paint contains pigments in the range from 8 wt. parts to 30 wt. parts.

The ratio of the alkyd paint and the clear paint to be blended in the stock solution is respectively 20–40 wt. parts of the alkyd paid and 5–30 wt. parts of the clear paint as against 100 wt. parts of the egg yolk. Addition of the alkyd paint in an amount less than 20 wt. parts results in insufficient coloring while its addition exceeding 40 wt. parts will deteriorate adhesion of the printing paste on the textile product. When the amount of the clear paint is less than 5 wt. parts, the printing paste cannot apply smoothly on the surface of a textile product, whereas if the amount exceeds 30 wt. parts, the paste will blur.

The printing paste according to the present invention is applicable to any of the hand printing techniques, such as, using brush, stencil, and screen or to the machine printing, such as, using roller, flat screen and rotary screen. The amount of alcohol and clear paint to be blended in the printing paste differ depending on the printing technique. For hand printing, the amount of alcohol is increased and the amount of clear paint is decreased for the increment. For machine printing, the amount of clear paint is increased and the amount of alcohol decreased accordingly.

Using any of the printing techniques mentioned above, a desired design in characters or graphics is printed on the textile surface at room temperature under ambient pressure.

Textile products to be used in the present invention may include fabrics made of cotton, linen, wool and synthetic fibers; blended, united or knitted fabrics; clothings, beddings, and fabric apparel accessories made of these fabrics. These textile products are made of such fabrics or according to such sewing specifications that they would not lose the shape or the body despite washing with water.

Textile products printed with the paste are subjected to spontaneous drying at room temperature under ambient pressure or to hot air drying to fix the paste as well as the alkyd paint on the products.

Dried textile products are washed with water below 40° C. to completely remove the residual paste, removed of washing water, and dried spontaneously or with hot air. The textile products are pressed with iron to suit the intended use.

As the egg yolk acts as a paste and an adhesive to fix the alkyd paint on the textile, the color printed on the textile will withstand repeated washings without discoloring.

The printing paste according to the present invention comprises as an adhesive paste egg yolk which is adhesive on textile products and as a color material an alkyd paint. The egg yolk acts as a medium for fixing the alkyd paint on the textile, so that the textile printed with the paste will demonstrate a highly improved color fastness to washing, withstanding repeated washings of more than one hundred times with water.

The present invention printing paste is particularly suitable for printing patterns on bedding linens, such as, sheets blanket coverlets, and uniforms used in hotels and hospitals where frequent washing is unavoidable.

The present invention will now be described in more detail by way of examples.

EXAMPLE 1

Five hundred grams of egg yolk separated freshly from the white are agitated at 20° C. under ambient pressure into a pasty state using a large size blender for home use. The pasty egg yolk is added with 10 g of powder preservative (SPP by Ueno Pharmaceuticals) containing sorbic acid and ortho-phenylphenol as the main components and 10 g of ethyl alcohol for disinfection. The mixture is further agitated thoroughly in the blender at 20° C. under ambient pressure to obtain a uniformly mixed stock solution.

The stock solution thus obtained is added with 150 g of an alkyd paint with red pigment of 10 wt. percent (for use on iron by Asahi Pen Corporation) and 60 g of a water soluble acrylic resin clear paint, thoroughly agitated at 20° C. under ambient pressure in the blender to obtain a uniformly mixed printing paste.

Using a paint brush, 50 sheets of bed linen for hotel use were hand-printed with a name. The hand-printed bed linens were dried spontaneously at 20° C. under ambient pressure and washed with water to remove the residual paste. After removing the washing water and drying, bed linens printed with the name in vivid red color without blurring were obtained.

EXAMPLE 2

One Kilogram of egg yolk freshly separated from the white was thoroughly agitated at 20° C. under ambient pressure into a pasty state using a blender for confectioners (by Fujii Kaki Co.). The pasty egg yolk is transferred into a vessel, added with 20 g of sodium benzonate and 30 g of methyl alcohol, and thoroughly agitated at 20° C. under ambient pressure in said blender to prepare a uniformly mixed stock solution.

The stock solution was added with 330 g of an alkyd paint with yellow pigment of 12 wt. percent (for use on iron by Asahi Pen Corporation) and 200 g of the acrylic resin clear paint from Example 1, thoroughly agitated at 20° C. under ambient pressure to obtain a uniformly mixed painting paste.

Using the paste and the rotary screen printing technique, 100 sheets of hotel bed linen were printed with a name. The printed bed linens were dried spontaneously at 20° C. under ambient pressure and washed with water to remove the residual paste. After removing the washing water and drying, bed linens printed with the name in vivid yellow color without blurring were obtained.

The bed linens obtained in Examples 1 and 2 were subjected to washing for 120 times using a rotary drum washing machine with water at 40° C. added with 0.1 wt. part of a synthetic detergent as against 100 wt. parts of water. The printed names in red and yellow showed no discoloration but maintained the vividness at the time of printing.

Printed portions of the bed linens obtained in Examples 1 and 2 were cut out to be used at test pieces for a washing test according to JIS L 0844 A-2.

The results are shown in Table 1, which indicates that the textile products printed in accordance with the present invention are excellent in color fastness to washing.

TABLE 1

| | Change in Color | Staining | |
|---|---|---|---|
| | | Cotton | Wool |
| Example 1 | Class 5 | Class 5 | Class 5 |
| Example 2 | Class 5 | Class 5 | Class 5 |

Judgment on change in color and staining is classified into 5 classes, Class 5 being the highest.

What is claimed is:

1. A printing paste of a uniformly kneaded mixture comprising 100 wt. parts of egg yolk, 1–10 wt. parts of a preservative, 1–10 wt. parts of a lower alcohol, 20–40 wt. parts of an alkyd paint and 5–30 wt. parts of a water soluble resin clear paint.

2. The printing paste of claim 1 wherein the preservative is selected from the group consisting of sorbic acid, ortho-phenylphenol, sodium benzonate, salt, sugar, salicylic acid, dehydroacetic acid, and parahydroxybenzoic ester.

3. The printing paste of claim 1 wherein the lower alcohol is methyl alcohol or ethyl alcohol.

4. The printing paste of claim 1 wherein the alkyd paint contains from 8 to 30 wt. parts of pigment and boiled oil.

5. A method for making the printing paste of claim 1 comprising (a) mixing egg yolk into a pasty state at room temperature;

(b) blending the pasty egg yolk with a preservative and lower alcohol at room temperature and ambient pressure to produce a stock solution; and (c) kneading the stock solution with an alkyd paint and water soluble acrylic resin paint at room temperature and ambient pressure.

6. A method for making the printing paste of claim 1 comprising (a) separating egg yolk from egg white and immediately thereafter, blending the separated egg yolk with an preservative and lower alcohol at room temperature and ambient pressure to produce a stock solution; and (b) blending the stock solution with an alkyd paint and water soluble acrylic resin paint and kneading the blend at room temperature.

* * * * *